343-700 MS AU 256 EX
4/11/78 CR 4,084,162

United States Patent [19]
Dubost et al.

[11] 4,084,162
[45] Apr. 11, 1978

[54] FOLDED BACK DOUBLET MICROSTRIP ANTENNA

[75] Inventors: Gerard Dubost, Rennes; Henri Albert Havot, Cession-Sevigny, both of France

[73] Assignee: Etat Francais represented by Delegation Ministerielle pour l'Armement, France

[21] Appl. No.: 686,394

[22] Filed: May 14, 1976

[30] Foreign Application Priority Data

May 15, 1975 France ..... 75 15114

[51] Int. Cl.[2] ..... H01Q 1/38; H01Q 9/26
[52] U.S. Cl. ..... 343/700 MS; 343/803; 343/807
[58] Field of Search ..... 343/795, 803, 804, 700 MS, 343/807

[56] References Cited

U.S. PATENT DOCUMENTS 2,617,028 11/1952 Stolk ..... 343/804
3,114,913 12/1963 Alford ..... 343/795
3,813,674 5/1974 Sidford ..... 343/803

FOREIGN PATENT DOCUMENTS 2,231,128 12/1974 France ..... 343/803

*Primary Examiner*—Eli Lieberman
*Attorney, Agent, or Firm*—Stevens, Davis, Miller & Mosher

[57] ABSTRACT

A folded back doublet antenna including two symmetrical half-plates separated at their one ends by a cut, a long, continuous plate separated from one side of each of the half-plates by a gap, linking sections joining the other external ends of the half-plates to respective ends of the continuous plate, and a line feeding the antenna in the vicinity of the cut and extending along the axis of symmetry of the half-plates. The half-plates have a common width, which is much larger than the width of the continuous plate. The half-plates constitute an input side and the continuous plate constitutes a folded back side.

3 Claims, 5 Drawing Figures

FIG. 1
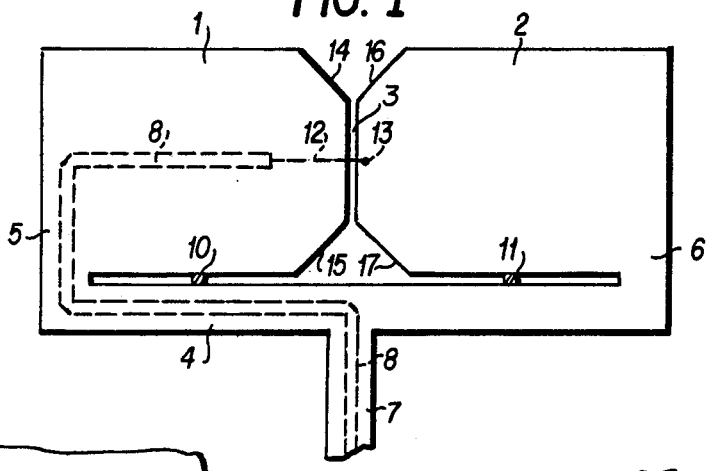
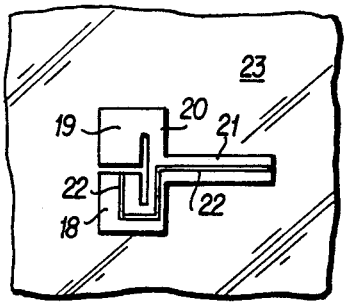
FIG. 2
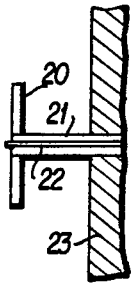
FIG. 3
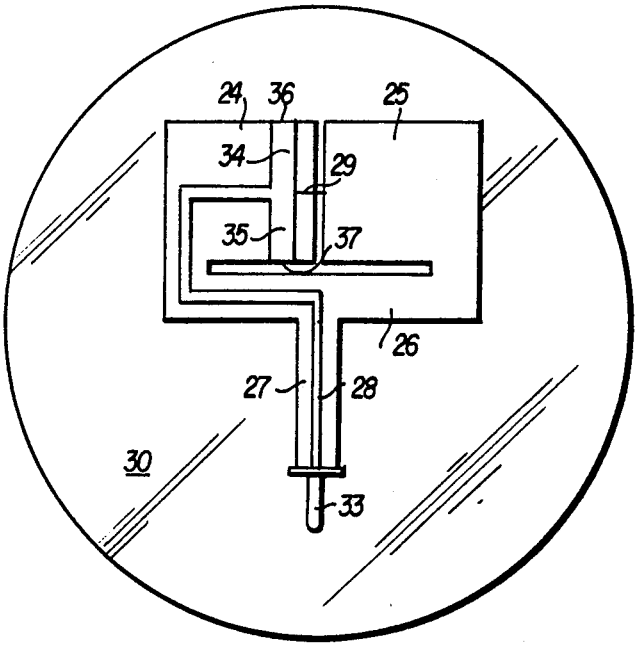
FIG. 4
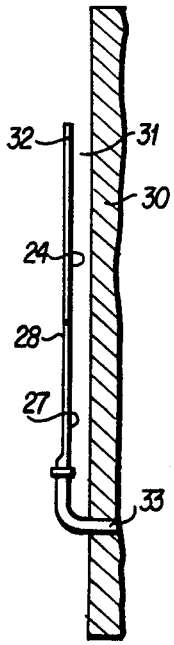
FIG. 5

FOLDED BACK DOUBLET MICROSTRIP ANTENNA

The present invention relates to plate-form folded back doublets and, more particularly, to plate-form folded back doublets which may be realized by the technique of printed circuits.

Research already has been done on plate-form antennae and it is known, for example, that it is possible to establish an equivalence between the width of a plate-form antenna and the diameter of the circular side of a doublet. Information on this equivalence may be found in the work of R. W. P. King, entitled "The Theory of Linear Antennas", published in 1956 by Harvard University Press, Cambridge, Mass., or in the work of H. Jasik, entitled "Antenna Engineering Handbook," published in 1961 by McGraw-Hill Book Company, Inc., New York, N.Y.

Plate-form antennae are also described in the technical article "Microstrip Antennas," by John Q. Howell, published in the magazine "IEEE Transactions on Antennas and Propagation," in January 1975, pages 90 to 93. In numerous applications these antennae have advantages on aeronautic or aerospace vehicles, given their dimensions and weight, but until now it has only been possible to obtain very small band widths of a few per cent.

In other respects, thick folded back doublets, or networks of thick folded back doublets, in which the diameter of the input side is clearly higher, in the order of 10 times than that of the folded back side, have already been described in French Patent Applications 73 19255, filed on 21st May 1973, in the joint names of G. Dubost and H. Havot; 74 24951, filed on 18th July 1974 in the name of the French Government; 74 34196, filed on 11th Oct. 1974 also in the name of the French Government; and 75 01379, filed on 15th Jan. 1975 again in the name of the French Government. French applications 74 24951 and 75 01379 have respectively corresponding U.S. applications Ser. No. 593,957, filed July 8, 1975, now Pat. No. 4,015,265 and Ser. No. 648,290, filed Jan. 12, 1976, now Pat. No. 4,005,430. These folded back doublets with a thick input side are of note mainly because of their dimensions, particularly their length, which are small in relation to the wave lengths of operation, if they are compared to those of conventional doublets, and also by their band passes which may be very wide.

One object of the present invention consists of providing a plate-form folded back doublet which has the advantages of the thick, folded back doublets mentioned above and which may have a band pass of large width.

According to one characteristic of the invention, a plate-form folded back doublet is provided which includes an input side, constituted by two symmetrical half-plates, separated by a cut and a folded back side constituted by a long, continuous plate, separated from the adjacent sides of the half-plates by a gap, the common width of the two half-plates being much larger than that of the long plate, the ends of the long plate being joined respectively to the external ends of the half-plates, the doublet being supplied by a line according to the axis of symmetry of the half-plates in the vicinity of the cut.

According to another characteristic, the half-plates of the input side and the plate of the folded back side are rectangular.

According to another characteristic, the half-plates of the input side are rectangular, except in the vicinity of the cut where the corners are cut and the plate of the folded back side is rectangular.

According to another characteristic, the supply line is a band-form line whose earth plate is constituted firstly by a plate normal to the plate of the folded back side, in the plane of the half-plates of the input side and the plate of the folded back side, whose axis of symmetry coincides with that of the doublet, then by the plate of the folded back side, then by the surface joining the plate of the folded back side to one of the two half-plates, and finally by this half-plate itself, the band of the band-form line being successively orientated according to the axis of symmetry of the associated earth plate, the said band being coupled at one end to the half-plate, which does not serve as its earth plate, and at its other end to a "band-form line — coaxial line" passage.

According to another characteristic, the band is connected to the half-plate, which does not serve as its earth plate, by a short line of high impedance.

According to another characteristic, the band is coupled to the half-plate, which does not serve as its earth plate, by a condenser.

According to another characteristic, two symmetrical short-circuits may be placed between each half-plate, respectively, and the plate of the folded back side above the said gap, for matching the impedance of the doublet.

According to another characteristic, the doublet is placed at a distance of 0.15λm from a plane reflector of appreciably larger dimensions and with a length of approximately 0.30λm. In this case the band pass is wide.

According to another characteristic, the doublet is placed at a distance of 3/100 of λ from a plane reflector of appreciably larger dimensions and with a length in the order of 0.6λ, the width being less. In this case, the band pass is narrower.

In these last two characteristics, λm is the wave length with the lower frequency of the band pass, while λ is the medium wave length of a narrower band pass.

These characteristics of the invention, along with others, will appear clearer upon reading the following description of exemplary embodiments, the said description being written in relation to the attached drawings.

FIG. 1 is a plan-view of a plate-form folded back doublet according to the invention, intended for operation between 460 and 850 MHz.

FIG. 2 is a plan-view of a plate-form folded back doublet according to the invention, intended for operation between 4.4 and 5.1 GHz.

FIG. 3 is a side view of the doublet of FIG. 2, mounted on a plane reflector.

FIG. 4 is a plan-view of a plate-form folded back doublet according to the invention, mounted very closely on a plane reflector and intended for operation at 3.6 GHz, with a band pass of 6% and for a standing wave ratio less than 2.

FIG. 5 is a side view of the doublet of FIG. 4.

The doublet of FIG. 1 is a folded back doublet which includes an input side, formed by two conductive half-plates 1 and 2, separated by a cut 3, a folded back side, formed by a plate 4 and by two symmetrical linking sections 5 and 6, respectively, joining, on the one hand, 1 and 4 and, on the other hand, 2 and 4. From a strictly structural point of view, each half-plate 1 or 2 is, in fact, a true plate which is appreciably rectangular, whose length is near to half the length of the doublet; but, given their radioelectric functions, which are closely bound to their length, it seemed easier to designate them by the term half-plate, which is in contrast to the term plate, used for the folded back side 4, which takes up the whole length of the doublet.

The plate 4 is connected, in its central part, to the earth plate 7, which is perpendicular to 4 and symmetrical in relation to the axis of symmetry of the doublet, of a band-form line 8. The band-form line 8 is indicated by dashed lines, as it passes under 7,4,5, and 1, successively, each of the metal surfaces 7,4,5, and 1 serving as earth surfaces to the line 8. In particular, under the half-plate 1, the line 8 is equidistant from the sides of 1.

By way of an example, the doublet of FIG. 1 may be provided for operation in the frequency band of 460 to 850 MHz, for instance, in a band width appreciably of an octave. It may therefore have the following dimensions: Total length, 200 mm; length of each half-plate 1 or 2, 100 mm; width of cut 3 between 1 and 2, 1.6 mm; length of the plate 4, 200 mm; width of 1 or 2, 70 mm; width of side 4, 15 mm; width of gap 9 between 4 and 1-2, 3 mm; width of sections 5 and 6, 15 mm; width of the earth plate 7, 15 mm; width of the band 8, 3.2 mm.

In the frequency band under consideration, the band-form line 7-8 has, considering its width and the dielectric, an impedance of 100 ohms. In order to match the outlet impedance of the doublet to this impedance of 100 ohms, provision has been made, on the one hand, between 1 and 4, and on the other hand, between 2 and 4, for short, conductive tapes 10 and 11 which constitute electric short-circuits; they are disposed symmetrically in relation to the axis of symmetry of the doublet and are fixed once the correct matching has been obtained by experiment. In a variant, a supply band-form line may be used, whose band 8 is wider in order to obtain an impedance of 50 ohms, the short-circuits 10 and 11 being omitted.

The band-form line 7-8 is extended towards the half-plate 2 by band-form line 12 of high impedance, which therefore is much narrower, represented by a dashed line and ending at a point 13 of half-plate 2, very near to the cut 3.

In the vicinity of the cut 3, the corners 14 to 17 of the half-plates 1 and 2 are cut away in order to modify the capacity created by the edges of the cut 3, which is in parallel with the impedance of radiation of the doublet in an equivalent circuit. It is obvious that, according to the frequency and dimensions chosen, there may be an advantage in increasing this capacity, and this may be achieved by slightly extending the line 7-8 directly under the plate 2, the line of high impedance 12 being omitted. Finally, it must be noted that at every change of direction of the line 7-8, the band 8 has its external corner cut in a conventional way.

In practice, the performances of a doublet of this sort were measured by disposing it parallel to a circular reflector plane of 1.2 diameter, at a distance of 10 cm. from this plane, in order to make the radiation unidirectional. This distance to the reflector plane corresponds to approximately 0.15λm, where λm is the wave length with the lower frequency of the band pass 460 to 850 MHz. It is to be noted that the length of the doublet is approximately 0.30λm and its width approximately 0.13λm.

The radiation patterns obtained are more directional than those of a conventional half-wave doublet disposed at 4/λ of a reflector plane. The maximum directivity deduced from the measured patterns remains higher than 8 dB in the whole band. The measured gain allows a loss of 1 to 1.5 dB in the antenna to be introduced. The Standing Wave Ratio (S.W.R.) of the impedance of the antenna brought back to 100 ohms remains less than 2.

In another exemplary embodiment shown in FIG. 2, the folded back doublet includes two half-plates 18 and 19, constituting the input side and a plate 20, constituting the folded back side. The doublet is supplied by a band-form line 21-22. This doublet is provided for operation in the band going from 4.4 to 5.1 GHz. The length of the doublet is 20 mm; the width of 18 or 19, 7 mm; that of 20, 3 mm; the gap between 20 and 18-19 has a width of 1 mm,; the width of the cut between 18 and 19 is 0.5 mm; that of the linking sections between the sides, 4 mm; finally that of the band 22, 0.4 mm. The length of the doublet, therefore, still corresponds to 0.30 or 0.29λ m (λm being the wave length with the frequency of 4.4 GHz), but the other dimensions cannot be automatically deduced by simple transposition from the doublet of FIG. 1. In effect, it is not for example possible to reduce the width of the plate 20 below a limit defined by the impedance of the band-form line 21-22, since the plate 20 serves as the earth plate to this band-form line. The narrow band 22 of the supply line is directly connected to a point of half-plate 19 in closed promimity to cut. The corners 18 and 19, in the vicinity of the cut, are not cut.

FIG. 3 shows a side view of the doublet of FIG. 2, placed 10 mm above a circular reflector plane, 300 mm in diameter. At a certain distance from the doublet, the line 21-22 is bent perpendicular to the reflector plane 23, so that it may be supplied across a coaxial-line passage disposed under 23.

According to the measurements taken, the S.W.R. of the impedance of radiation brought back to 100 ohms is less than 2 for the frequencies comprised between 4.2 and 5.2 GHz. The maximum linear isotropic directivity is 7.5 dB and the measured gain corresponds to a loss of 1 to 1.5 dB, which may be reduced by using a dielectric with smaller losses.

It should be noted that the radioelectric characteristics of the doublets of FIGS. 1 and 2 are those of antennae with wide bands.

With regard to the apertures of the directivity patterns at 3dB in the planes E and H, the following measurements, summarized in two tables, were obtained.

| Doublet in Figure 1 | | | | | | |
|---|---|---|---|---|---|---|
| f(MHz) | 450 | 500 | 600 | 700 | 800 | 850 |
| Plane E | 66° | 66° | 64° | 66° | 63° | 62° |
| Plane H | 82° | 86° | 86° | 95 | 100° | 105° |
| Doublet in Figure 2 | | | | | | |
| f(GHz) | 4.5 | 4.6 | 4.7 | 4.8 | 4.9 | 5 |
| Plane E | 70° | 72° | 72° | 70° | 66° | 68° |
| Plane H | 100° | 106° | 106° | 105° | 108° | 106° |

It should be noted that the patterns in the planes E and H are more directional than those of a conventional cylindrical half-wave doublet disposed in parallel at λ/4 from a reflector plane, whose apertures at 3 dB are respectively: $O_E = 72°$ and $O_H = 120°$.

It should also be observed that these two doublets, described above, are realized on double face printed circuits, with a thickness of 1.6 mm and dielectric of epoxy glass. It is known that the simple embodiment with printed circuit of a unidirectional radiation source of this type, allows directional networks to be formed, mainly in the UHF band, or according to the description given in the afore-mentioned patent application 73 19255.

In these first two exemplary embodiments, the length of the doublet was approximately 0.3λm and the distance to the reflector approximately 0.15λm. The doublet shown in FIG. 4 differs from the first two in that it is provided for operating very near to the reflector plane. The dimensions around the whole doublet of FIG. 4 are approximately the size of the wave length, in order to have an adequate band width. It still includes two half-plates 24 and 25, constituting the input side, and a plate 26, constituting the folded back side. It is supplied by a band-form line 27–28, extended by a line of high impedance 29 towards 25.

By way of an example, in order to operate in a frequency band of 3.3 to 3.6 GHz, the doublet of FIG. 4 has the following dimensions: length 51 mm; width of 24 or 25, 22 mm; width of 26, 7 mm; width of the cut between 24 and 25, 0.5 mm; width of the gap between 26 and 24–25, 2mm, width of the linking sections between 26 and 24 or 26 and 25, 7mm; width of 27, 7 mm; and width of band 28, 1.6 mm. Finally, the doublet is placed, as shown in FIG. 5, 2.5 mm in front of a circular reflector plane, 300 mm in diameter, in order to make the radiation unidirectional. It is to be noted in FIG. 5, that the band 28 is situated at the other side of the sides 24–25 and 26, in relation to the reflector plane 30. Therefore, on leaving the reflector 30 there is an insulating layer 31, then a second insulating layer 32, on which, on one side, the whole of the plates 24 to 27 is printed and, on the other side, the band 28; a link with a coaxial cable 33 is established at a chosen convenient point of the reflector 30. The distance to the reflector plane 30 is, therefore, approximately 0.0275λm only. The insulating layer 31 may be (instead of air) a solid dielectric, the whole of the doublet then being realized in the form of a plated double printed circuit on a reflective surface.

In the course of the measurement, it was stated with the doublet of FIG. 4, that the S.W.R. is less than 2, in a band pass of approximately 6% and less than 3, in a band of approximately 8.7%. The isotropic linear gain remains included between 5 and 6 dB for frequencies rising from 3.3 to 3.6 GHz.

The secondary lobes brought back to the maximum of the radiation pattern are always less than 22 dB.

The following table gives the apertures at 3 db of the directivity patterns in the planes E and H.

| f(GHz) | 3.3 | 3.4 | 3.5 | 3.6 |
|---|---|---|---|---|
| Plane E | 58° | 60° | 58° | 58° |
| Plane H | 88° | 82° | 82° | 79° |

It could be noted that these radioelectric performances are higher than those given in the recent article quoted in the introduction of the present description.

It must also be noted, by way of a variant, that near the point of supply of the doublet, two quarter wave band-form lines 34 and 35 may be provided, short circuited at their ends as indicated by the points 36 and 37. These lines, which are disposed in parallel on the principal band-form line of supply, allow a better matching of the radiation impedance to be obtained.

Although the principles of the present invention have been described above in relation to particular exemplary embodiments, it should be understood that the said description has only been given by way of an example and does not limit the scope of the invention.

What is claimed is:

1. A folded back doublet antenna system comprising:

(a) two symmetrical half-plates separated at their one ends by a cut;

(b) a long, continuous plate separated from one side of each of said half-plates by a gap, said half-plates constituting an input side and said continuous plate constituting a folded back side, said half-plates having a common width which is much larger than the width of said continuous plate, said continuous plate being joined at its ends to, respectively, the other external ends of said half-plates by respective linking sections, said half-plates and continuous plate forming a doublet antenna;

(c) a line feeding the doublet antenna in the vicinity of said cut and extending along the axis of symmetry of said half-plates; and (d) a plane reflector of appreciably larger dimensions than the doublet antenna, the doublet antenna being at a distance of 3/100 of λ from said reflector and having a length of approximately 0.6 λ, the width of the antenna being less, wherein λ represents the medium wavelength of the band pass of said antenna.

2. A folded back doublet antenna according to claim 1, wherein said half-plates and said continuous plate are rectangular.

3. A folded back doublet antenna according to claim 1, wherein said half-plates are rectangular, except in the vicinity of said cut where the corners of said half-plates are cut away, and said plate is rectangular.

* * * * *